US008099275B2

(12) United States Patent
Oshikiri

(10) Patent No.: US 8,099,275 B2
(45) Date of Patent: Jan. 17, 2012

(54) SOUND ENCODER AND SOUND ENCODING METHOD FOR GENERATING A SECOND LAYER DECODED SIGNAL BASED ON A DEGREE OF VARIATION IN A FIRST LAYER DECODED SIGNAL

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1011 days.

(21) Appl. No.: 11/577,424

(22) PCT Filed: Oct. 25, 2005

(86) PCT No.: PCT/JP2005/019579

§ 371 (c)(1),
(2), (4) Date: Apr. 18, 2007

(87) PCT Pub. No.: WO2006/046547

PCT Pub. Date: May 4, 2006

(65) Prior Publication Data

US 2008/0091440 A1 Apr. 17, 2008

(30) Foreign Application Priority Data

Oct. 27, 2004 (JP) ..... 2004-312262

(51) Int. Cl.

| | |
|---|---|
| ***G06F 15/00*** | (2006.01) |
| ***G10L 11/00*** | (2006.01) |
| ***G10L 19/00*** | (2006.01) |
| ***G10L 11/04*** | (2006.01) |

(52) U.S. Cl. ..... 704/206; 704/200; 704/200.1; 704/219; 704/220

(58) Field of Classification Search ..... 704/200, 704/200.1, 206, 219, 220
See application file for complete search history.

(56) References Cited

U.S. PATENT DOCUMENTS

| | | | | |
|---|---|---|---|---|
| 5,884,269 | A * | 3/1999 | Cellier et al. | 704/501 |
| 6,094,636 | A * | 7/2000 | Kim | 704/500 |
| 6,614,370 | B2 * | 9/2003 | Gottesman | 341/94 |

(Continued)

FOREIGN PATENT DOCUMENTS

JP 8-288852 11/1996

(Continued)

OTHER PUBLICATIONS

Oshikiri et al., "A Scalable coder designed for 10-KHZ bandwidth speech", Speech Coding, 2002, IEEE Workshop Proceedings, Oct. 6-9, 2002, Piscataway, NJ, USA, IEEE, Oct. 6, 2002, pp. 111-113, XP010647230, ISBN: 978-0-7803-7549-9.

Taddei et al., "A Scalable Three Bit Rate (8, 14.2, and 24 kbit/s) Audio Coder", 107$^{th}$ Convention / AES, Audio Engineering Society : Sep. 24, 1999 19990924: 19990924-19990927 New York, NY; AES, Sep. 24, 1999, pp. 1-12, XP002555806.

(Continued)

*Primary Examiner* — Eric Yen
(74) *Attorney, Agent, or Firm* — Greenblum & Bernstein, P.L.C.

(57) ABSTRACT

A sound encoder having an improved quantization performance while suppressing an increase of the bit rate to a lowest level. In a second layer encoder, a standard deviation calculator calculates a standard deviation σc of a first layer decoding spectrum after decoding a scale factor ratio multiplication and outputs the standard deviation σc to a selector. The selector selects a linear transform function as a function for a nonlinear transform of a residual spectrum according to the standard deviation σc A nonlinear transform function selects one of prepared nonlinear transform functions #1 to #N according to a result of the selection by the selector, and outputs the selected one to an inverse transformer. The inverse transformer subjects an inverse transform (expansion) to a residual spectrum candidate that is stored in a residual spectrum code book using the nonlinear transform function outputted from the nonlinear transform function and outputs the result to an adder.

20 Claims, 13 Drawing Sheets

U.S. PATENT DOCUMENTS

| | | | | |
|---|---|---|---|---|
| 6,615,169 | B1 * | 9/2003 | Ojala et al. | 704/205 |
| 6,947,886 | B2 * | 9/2005 | Rose et al. | 704/200.1 |
| 7,275,036 | B2 * | 9/2007 | Geiger et al. | 704/500 |
| 7,277,849 | B2 * | 10/2007 | Streich et al. | 704/229 |
| 7,457,742 | B2 * | 11/2008 | Kovesi et al. | 704/201 |
| 7,752,052 | B2 * | 7/2010 | Oshikiri | 704/500 |
| 7,787,632 | B2 * | 8/2010 | Ojanpera | 381/23 |
| 2002/0133246 | A1 * | 9/2002 | Kim et al. | 700/94 |
| 2003/0212551 | A1 * | 11/2003 | Rose et al. | 704/230 |
| 2003/0220783 | A1 * | 11/2003 | Streich et al. | 704/200.1 |
| 2005/0010404 | A1 * | 1/2005 | Son et al. | 704/219 |

FOREIGN PATENT DOCUMENTS

| | | |
|---|---|---|
| JP | 8-288852 | 9/1998 |

OTHER PUBLICATIONS

Anibal J.S. Ferreira: "Optimum Quantization of Flattened MDCT Coefficients", 115$^{th}$ Convention of AES, Oct. 10-13, 2003, XP002584978.

Oshikiri et al., "Jikan—Shuhasu Ryoiki no Keisu no teio Sentaku Vector Ryoshika o Mochiita 10kHz Taiiki Scalable Fugoka Hoshiki", FIT2003 Koen Ronbunshu, Aug. 25, 2003, F-017, pp. 239 to 240.

Miki, All about MPEG-4, First Edition, Kogyo Chosakai Publishing, Inc., Sep. 30, 1998, pp. 126-127.

U.S. Appl. No. 11/577,638 to Oshikiri, which was filed on Apr. 20, 2007.

English language Abstract of JP 8-288852, Sep. 30, 1998.

* cited by examiner

SOUND ENCODER AND SOUND ENCODING METHOD FOR GENERATING A SECOND LAYER DECODED SIGNAL BASED ON A DEGREE OF VARIATION IN A FIRST LAYER DECODED SIGNAL

TECHNICAL FIELD

The present invention relates to a speech coding apparatus and a speech coding method, and more particularly, to a speech coding apparatus and a speech coding method that are suitable for scalable coding.

BACKGROUND ART

In order to effectively use radio wave resources or the like in a mobile communication system, it is required to compress a speech signal at a low bit rate. Meanwhile, it is desired to improve telephone sound quality and realize telephone call services with high fidelity. In order to realize this, it is preferable not only to improve the quality of a speech signal but also to be capable of also encoding signals other than speech, such as an audio signal with wider band with high quality.

Approaches of hierarchically integrating a plurality of coding techniques are promising solutions for such contradictory demands. One of the approaches is a coding method in which a first layer is hierarchically combined with a second layer. The first layer encodes an input signal at a low bit rate using a model suitable for a speech signal, and the second layer encodes a differential signal between the input signal and a signal decoded in the first layer using a model also suitable for signals other than speech. In the coding method having such a layered structure, a bit stream obtained by coding has scalability (a decoded signal can be also obtained from part of information of the bit stream), and therefore, the coding method is called scalable coding. The scalable coding has a feature of being capable of also flexibly supporting communication between networks having different bit rates. This feature is suitable for a future network environment where a variety of networks will be integrated with IP protocol.

As conventional scalable coding, for example, there is scalable coding performed using a technique standardized by MPEG-4 (Moving Picture Experts Group phase-4) (see Non-Patent Document 1). In this scalable coding, CELP (Code Excited Linear Prediction) suitable for a speech signal is used in a first layer, and transform coding such as AAC (Advanced Audio Coder) and TwinVQ (Transform Domain Weighted Interleave Vector Quantization), which is performed on a residual signal obtained by subtracting a decoded signal in the first layer from an original signal, is used as a second layer.

There is a technique for efficiently quantizing a spectrum in transform coding (see Patent Document 1). In this technique, a spectrum is divided into blocks, and a standard deviation representing the degree of variation of coefficients included in the block is obtained. Then, a probability density function of the coefficients included in the block is estimated according to a value of this standard deviation, and a quantizer suitable for the probability density function is selected. By this technique, it is possible to reduce quantization errors in the spectrum and improve the sound quality.

Patent Document 1: Japanese Patent No. 3299073 Non-Patent Document 1: Sukeichi Miki, All about MPEG-4, First Edition, KogyoChosakai Publishing, Inc., Sep. 30, 1998, pp. 126-127

DISCLOSURE OF INVENTION

Problems to Be Solved by the Invention

However, in the technique described in Patent Document 1, a quantizer is selected according to the distribution of the signal which is a quantization target, and therefore it is necessary to encode selection information indicating which quantizer is selected and transmit the encoded selection information to a decoding apparatus. Therefore, the bit rate increases by the amount of the selection information as additional information.

It is therefore an object of the present invention to provide a speech coding apparatus and a speech coding method that are capable of minimizing the bit rate and improving quantization performance.

Means for Solving the Problem

A speech coding apparatus of the present invention performs encoding having a layered structure configured with a plurality of layers and adopts a configuration including: an analysis section that analyzes spectrum of a decoded signal of a lower layer to calculate a decoded spectrum of the lower layer; a selection section that selects one nonlinear transform function among a plurality of nonlinear transform functions based on a degree of variation of the decoded spectrum of the lower layer; an inverse transform section that inverse transforms a nonlinear transformed residual spectrum using the nonlinear transform function selected by the selection section; and an addition section that adds the inverse transformed residual spectrum to the decoded spectrum of the lower layer to obtain a decoded spectrum of an upper layer.

Advantageous Effect of the Invention

According to the present invention, it is possible to minimize the bit rate and improve quantization performance.

BEST MODE FOR CARRYING OUT THE INVENTION

Embodiments of the present invention will be described in detail below with reference to the accompanying drawings. In each embodiment, scalable coding having a layered structure configured with a plurality of layers is performed. Further, in each embodiment, as an example, it is assumed that: (1) the layered structure of scalable coding has two layers including a first layer (lower layer) and a second layer (upper layer) which is at a higher rank than the first layer; (2) in second layer coding, encoding (transform coding) is performed in the frequency domain; (3) for a transform scheme in second layer coding, MDCT (Modified Discrete Cosine Transform) is used; (4) in second layer coding, an input signal band is divided into a plurality of subbands (frequency bands) and encoding is performed in each subband unit; and (5) in second layer coding, the input signal band is divided into subbands corresponding to critical bands and at same intervals with Bark scale.

Embodiment 1

Figure 1:
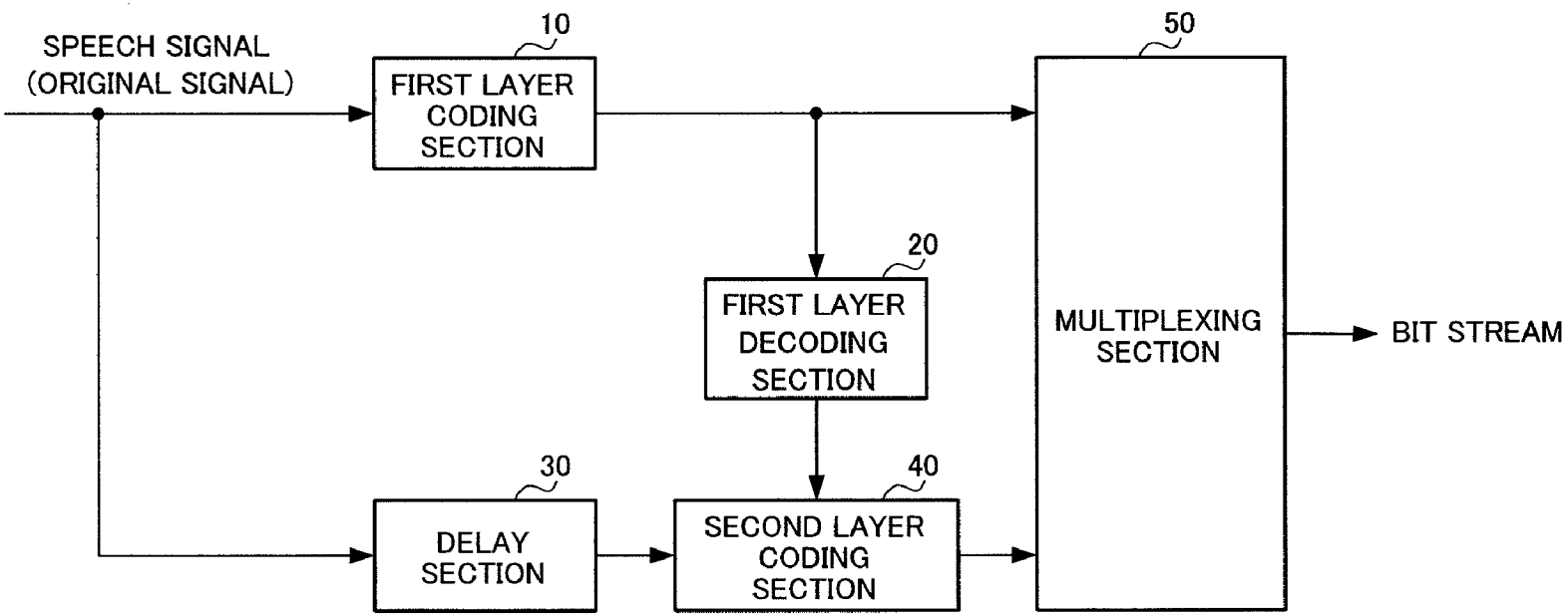
FIG. 1 is a block diagram showing the configuration of a speech coding apparatus according to Embodiment 1 of the present invention.

The configuration of a speech coding apparatus according to Embodiment 1 of the present invention is shown in FIG. 1.

In FIG. 1, first layer coding section 10 outputs the coded parameter obtained by encoding the inputted speech signal (original signal) to first layer decoding section 20 and multiplexing section 50.

First layer decoding section 20 generates a first layer decoded signal from the coded parameter outputted from first layer coding section 10 and outputs the first layer decoded signal to second layer coding section 40.

Delay section 30 gives a delay of a predetermined length to the inputted speech signal (original signal) and outputs the result to second layer coding section 40. The delay is for adjusting the time delay occurring in first layer coding section 10 and first layer decoding section 20.

Second layer coding section 40 encodes spectrum of the original signal outputted from delay section 30 using the first layer decoded signal outputted from first layer decoding section 20, and outputs the coded parameter obtained by the spectrum encoding to multiplexing section 50.

Multiplexing section 50 multiplexes the coded parameter outputted from first layer coding section 10 and the coded parameter outputted from second layer coding section 40, and outputs the multiplexed coded parameter as a bit stream.

Next, second layer coding section 40 will be described in more detail. The configuration of second layer coding section 40 is shown in FIG. 2.

Figure 2:
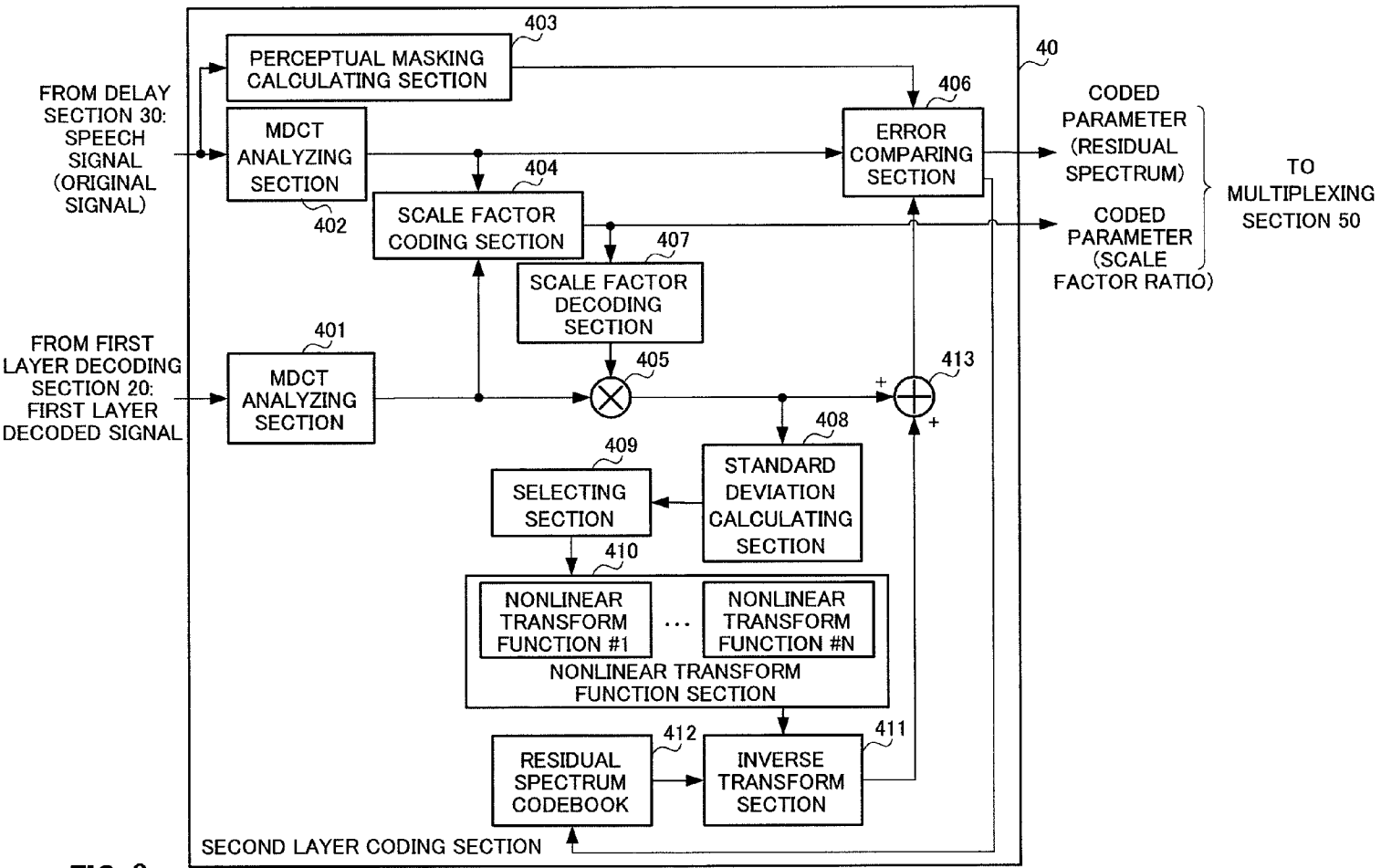
FIG. 2 is a block diagram showing the configuration of a second layer coding section according to Embodiment 1 of the present invention.

In FIG. 2, MDCT analyzing section 401 analyzes spectrum of a first layer decoded signal outputted from first layer decoding section 20 by MDCT transform and calculates MDCT coefficients (first layer decoded spectrum) and outputs the first layer decoded spectrum to scale factor coding section 404 and multiplier 405.

MDCT analyzing section 402 analyzes spectrum of the original signal outputted from delay section 30 by MDCT transform and calculates MDCT coefficients (original spectrum) and outputs the original spectrum to scale factor coding section 404 and error comparing section 406.

Perceptual masking calculating section 403 calculates perceptual masking for each subband having a predetermined bandwidth using the original signal outputted from delay section 30 and reports the perceptual masking to error comparing section 406. Human auditory perception has perceptual masking characteristics that, when a given signal is being heard, even if sound having a frequency close to that signal comes to the ear, the sound is difficult to be heard. The above-described perceptual masking is utilized to implement efficient spectrum coding by performing distribution so that the number of quantization bits is reduced in a frequency spectrum where quantization distortion is difficult to be heard and the number of quantization bits is increased in a frequency spectrum where quantization distortion is easy to be heard by utilizing the human perceptual masking characteristics.

Scale factor coding section 404 performs encoding of a scale factor (information indicating a spectrum envelope). As the information indicating the spectrum envelope, an average amplitude for each subband is used. Scale factor coding section 404 calculates a scale factor of each subband in the first layer decoded signal based on the first layer decoded spectrum outputted from MDCT analyzing section 401. At the same time, scale factor coding section 404 calculates a scale factor of each subband of the original signal based on the original spectrum outputted from MDCT analyzing section 402. Scale factor coding section 404 then calculates the ratio of the scale factor of the first layer decoded signal to the scale factor of the original signal and outputs the coded parameter obtained by encoding the scale factor ratio, to scale factor decoding section 407 and multiplexing section 50.

Scale factor decoding section 407 decodes a scale factor ratio based on the coded parameter outputted from scale factor coding section 404, and outputs the decoded ratio (decoded scale factor ratio) to multiplier 405.

Multiplier 405 multiplies the first layer decoded spectrum outputted from MDCT analyzing section 401 by the decoded scale factor ratio outputted from scale factor decoding section 407 for each corresponding subband, and outputs a multiplication result to standard deviation calculating section 408 and adder 413. As a result, the scale factor of the first layer decoded spectrum approximates the scale factor of the original spectrum.

Standard deviation calculating section 408 calculates standard deviation $\sigma c$ of the first layer decoded spectrum multiplied by the decoded scale factor ratio, and outputs standard deviation ac to selecting section 409. Upon calculation of standard deviation $\sigma c$, the spectrum is separated into an amplitude value and positive and negative sign information, and the standard deviation is calculated for the amplitude value. By the calculation of the standard deviation, the degree of variation of the first layer decoded spectrum is quantified.

Selecting section 409 selects which nonlinear transform function is used in inverse transform section 411 as a function for performing inverse nonlinear transform on a residual spectrum based on standard deviation $\sigma c$ outputted from standard deviation calculating section 408. Selecting section 409 then outputs information indicating the selection result to nonlinear transform function section 410.

Nonlinear transform function section 410 outputs one of a plurality of prepared nonlinear transform functions #1 to #N to inverse transform section 411 based on the selection result obtained by selecting section 409.

Residual spectrum codebook 412 stores a plurality of residual spectrum candidates obtained from compressing by nonlinear transform and compression of the residual spectrum. The residual spectrum candidates stored in residual spectrum codebook 412 may be scalars or vectors. Residual spectrum codebook 412 is designed in advance using training data.

Inverse transform section 411 performs inverse transform (expansion processing) on one of the residual spectrum candidates stored in residual spectrum codebook 412 using the nonlinear transform function outputted from nonlinear transform function section 410 and outputs the result to adder 413. This is because second layer coding section 40 is configured to minimize errors with the expanded signal.

Adder 413 adds the inverse transformed (expanded) residual spectrum candidate to the first layer decoded spectrum multiplied by the decoded scale factor ratio, and outputs the result to error comparing section 406. The spectrum obtained as a result of the addition corresponds to a candidate for a second layer decoded spectrum.

That is, second layer coding section 40 includes the same configuration as a second layer decoding section included in the speech decoding apparatus described later, and generates a second layer decoded spectrum candidate to be generated by the second layer decoding section.

Error comparing section 406 compares the original spectrum with the second layer decoded spectrum candidate for part or all of the residual spectrum candidates in residual spectrum codebook 412 using the perceptual masking obtained from perceptual masking calculating section 403, and thereby searches for the most appropriate residual spectrum candidate in residual spectrum codebook 412. Then, error comparing section 406 outputs a coded parameter indicating the searched residual spectrum to multiplexing section 50.

Figure 3:
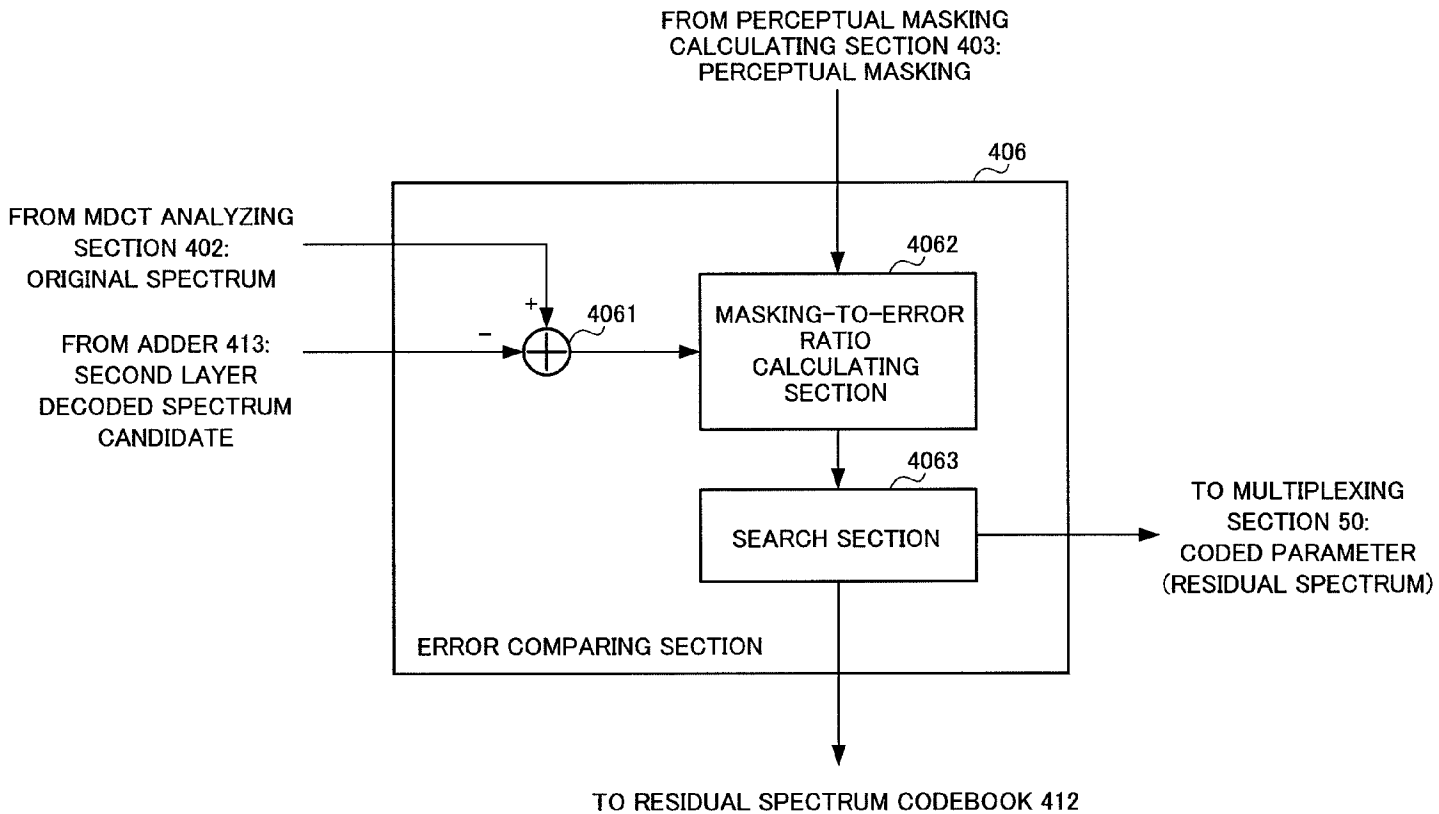
FIG. 3 is a block diagram showing the configuration of an error comparing section according to Embodiment 1 of the present invention.

The configuration of error comparing section 406 is shown in FIG. 3. In FIG. 3, subtractor 4061 subtracts a second layer decoded spectrum candidate from the original spectrum and thereby generates an error spectrum and outputs the error spectrum to masking-to-error ratio calculating section 4062. Masking-to-error ratio calculating section 4062 calculates the ratio of perceptual masking effect level to an error spectrum level (masking-to-error ratio) and quantifies how much error spectrum is perceived by the human auditory perception. When the calculated masking-to-error ratio is higher, the error spectrum with respect to the perceptual masking becomes small, that is, perceptual distortion perceived by human is reduced. Search section 4063 searches, among part or all of the residual spectrum candidates in residual spectrum codebook 412, for a residual spectrum candidate with which the masking-to-error ratio is highest (that is, the error spectrum to be perceived is smallest). Search section 4063 then outputs a coded parameter indicating the searched residual spectrum candidate to multiplexing section 50.

Second layer coding section 40 may adopt a configuration in which scale factor coding section 404 and scale factor decoding section 407 are removed from the configuration shown in FIG. 2. In this case, a first layer decoded spectrum is provided to adder 413 without an amplitude value being corrected by a scale factor. That is, the expanded residual spectrum is directly added to the first layer decoded spectrum.

In the above description, the configuration has been described in which a residual spectrum is subjected to inverse transform (expansion) in inverse transform section 411, but the following configuration may also be adopted. That is, it is also possible to adopt a configuration of subtracting a first layer decoded spectrum multiplied by a scale factor ratio from the original spectrum to generate a target residual spectrum, performing forward transform (compression) on the target residual spectrum using a selected nonlinear transform function, and searching and determining a residual spectrum that is closest to the nonlinear-transformed target residual spectrum from the residual spectrum codebook. In this configuration, instead of inverse transform section 411, a forward transform section that performs forward transform (compression) on a target residual spectrum using a nonlinear transform function is used.

Figure 4:
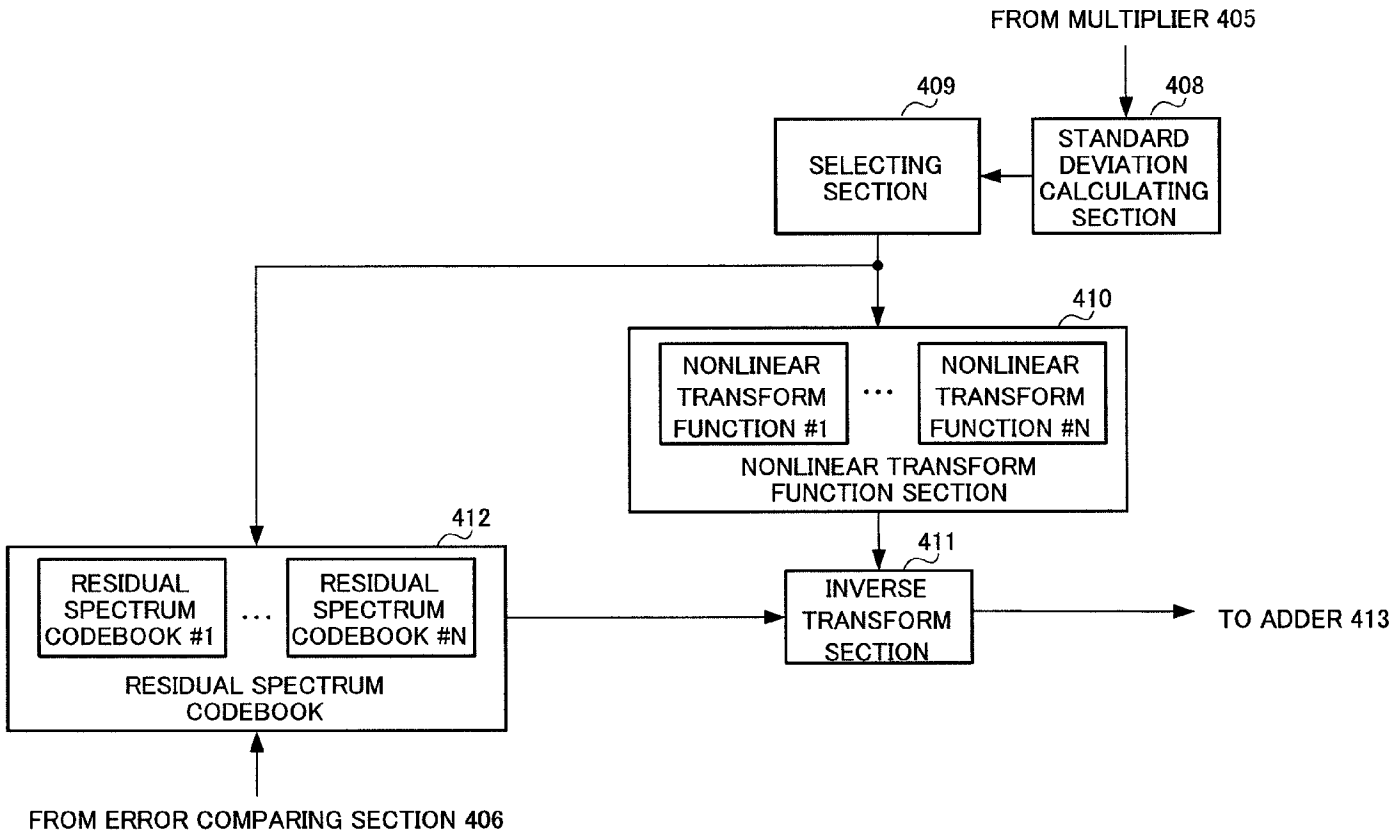
FIG. 4 is a block diagram showing the configuration of the second layer coding section according to Embodiment 1 of the present invention (variant)

Alternatively, as shown in FIG. 4, it is also possible to adopt a configuration where residual spectrum codebook 412 has residual spectrum codebooks #1 to #N corresponding to nonlinear transform functions #1 to #N, and selection result information from selecting section 409 is also inputted to residual spectrum codebook 412. In this configuration, one of the residual spectrum codebooks #1 to #N corresponding to a nonlinear transform function selected by nonlinear transform function section 410 is selected based on the selection result at selecting section 409. By adopting such a configuration, an optimal residual spectrum codebook for each nonlinear transform function can be used, and sound quality can be further improved.

Figure 5:
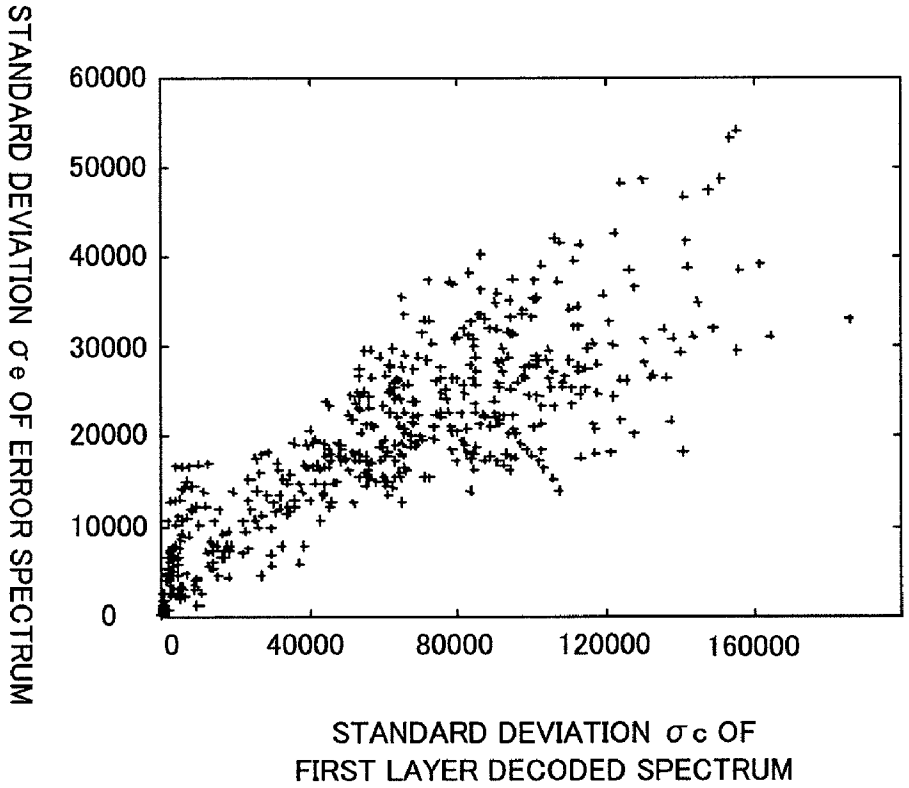
FIG. 5 is a graph showing a relationship between a standard deviation of a first layer decoded spectrum and a standard deviation of an error spectrum, according to Embodiment 1 of the present invention.

Next, the selection of a nonlinear transform function in selecting section 409 based on standard deviation $\sigma c$ of a first layer decoded spectrum will be described in detail. A graph in FIG. 5 shows a relationship between standard deviation $\sigma c$ of the first layer decoded spectrum and standard deviation $\sigma e$ of the error spectrum generated by subtracting the first layer decoded spectrum from the original spectrum. This graph shows results for a speech signal for about 30 seconds. The error spectrum as referred to herein corresponds to a spectrum which is to be encoded by the second layer. Thus, it becomes important how this error spectrum can be encoded with high quality (so that perceptual distortion is reduced) with a smaller number of bits.

When bit allocation to first layer encoding is sufficiently high, the characteristics of the error spectrum becomes almost white. However, under practical bit allocation, the characteristics of the error spectrum are not sufficiently whitened, and therefore the characteristics of the error spectrum are somewhat similar to the spectrum characteristics of the original signal. Therefore, it is considered that there is correlation between standard deviation $\sigma c$ of the first layer decoded spectrum (the spectrum encoded and obtained to approximate the original spectrum) and standard deviation $\sigma e$ of the error spectrum.

This fact can be verified by the graph in FIG. 5. Namely, by the graph in FIG. 5, it can be seen that there is positive correlation between standard deviation $\sigma c$ of the first layer decoded spectrum (the degree of variation of first layer decoded spectrum) and standard deviation $\sigma e$ of the error spectrum (the degree of variation of error spectrum). There is a tendency that when standard deviation $\sigma c$ of the first layer decoded spectrum is small, standard deviation $\sigma e$ of the error spectrum also becomes small, and, when standard deviation $\sigma c$ of the first layer decoded spectrum is large, standard deviation $\sigma e$ of the error spectrum also becomes large.

In the present embodiment, by utilizing such a relationship, in selecting section 409, standard deviation σe of the error spectrum is estimated from standard deviation σc of the first layer decoded spectrum, and an optimal nonlinear transform function for estimated standard deviation σe is selected from nonlinear transform functions #1 to #N.

Figure 6:
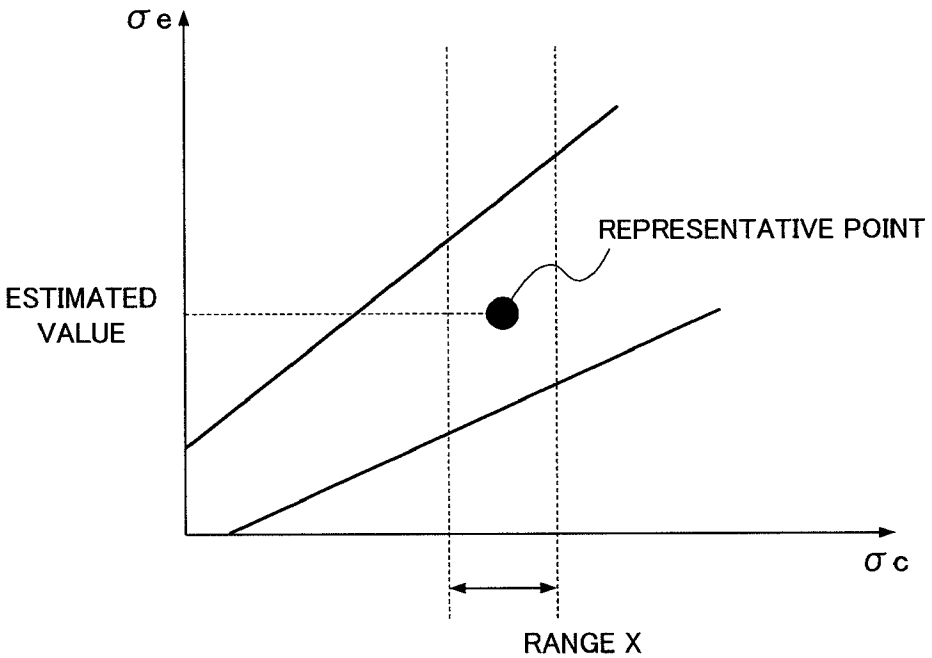
FIG. 6 shows a method of estimating the standard deviation of the error spectrum, according to Embodiment 1 of the present invention.

A specific example in which standard σe of the error spectrum is determined from standard deviation σc of the first layer decoded spectrum will be described using FIG. 6. In FIG. 6, the horizontal axis represents standard deviation σc of the first layer decoded spectrum and the vertical axis represents standard σe of the error spectrum. When standard deviation σc of the first layer decoded spectrum belongs to range X, standard deviation σe represented by a predetermined representative point for range X is determined as an estimated value of standard deviation σe of the error spectrum.

By thus estimating standard deviation σe of the error spectrum (the degree of variation of error spectrum) based on standard deviation σc of the first layer decoded spectrum (the degree of variation of first layer decoded spectrum) and selecting an optimal nonlinear transform function for the estimated value, the error spectrum can be efficiently encoded. Since a first layer decoded signal can also be obtained on the speech decoding apparatus side, it is not necessary to transmit information indicating a selection result of a nonlinear transform function to the speech decoding apparatus side. Accordingly, it is possible to suppress an increase of the bit rate and perform encoding with high quality.

Figure 7:
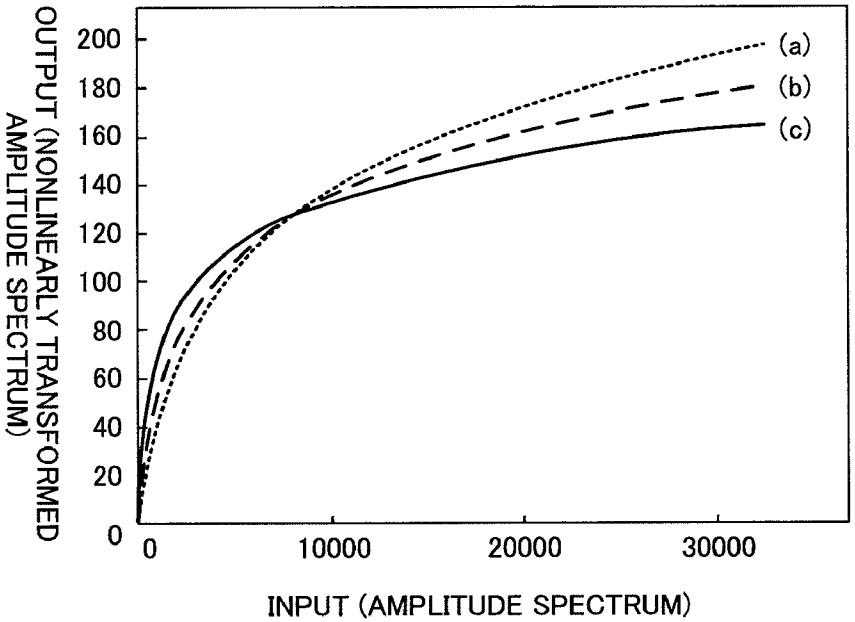
FIG. 7 shows an example of a nonlinear transform function according to Embodiment 1 of the present invention.

Next, an example of a nonlinear transform function is shown in FIG. 7. In this example, three types of logarithmic functions (a) to (c) are used. A nonlinear transform function to be selected in selecting section 409 is selected according to the magnitude of an estimated value of a standard deviation of an encoding target (standard deviation σc of the first layer decoded spectrum in the present embodiment). Specifically, when the standard deviation is small, a nonlinear transform function suitable for a signal with little variation, such as the function (a), is selected, and, when the standard deviation is large, a nonlinear transform function suitable for a signal with large variation, such as the function (c), is selected. In this way, in the present embodiment, one of nonlinear transform functions is selected according to the magnitude of standard deviation σe of the error spectrum.

As a nonlinear transform function, a nonlinear transform function used for μ-law PCM, such as one expressed by equation 1 is used.

[1]

$$F(\mu, x) = A \cdot \mathrm{sgn}(x) \cdot \frac{\log_b(1 + \mu \cdot |x| / B)}{\log_b(1 + \mu)} \quad \text{(Equation 1)}$$

In equation 1, A and B each represent a constant that defines the characteristics of a nonlinear transform function, and sgn( ) represents a function that returns a sign. For base b, a positive real number is used. A plurality of nonlinear transform functions having different μ are prepared in advance, and which nonlinear transform function to use when encoding the error spectrum is selected based on standard deviation σc of the first layer decoded spectrum. For an error spectrum with a small standard deviation, a nonlinear transform function with small μ is used, and for an error spectrum with a large standard deviation, a nonlinear transform function with large μ is used. Since appropriate μ depends on the property of first layer encoding, it is determined in advance by utilizing training data.

As a nonlinear transform function, a function expressed by equation 2 may be used.

[2]

$$F(\alpha, x) = A \cdot \mathrm{sgn}(x) \cdot \log_\alpha(1 + |x|) \quad \text{(Equation 2)}$$

In equation 2, A represents a constant that defines the characteristics of a nonlinear function. In this case, a plurality of nonlinear transform functions having different bases a are prepared in advance, and which nonlinear transform function to use when encoding the error spectrum is selected based on standard deviation σc of the first layer decoded spectrum. For an error spectrum with a small standard deviation, a nonlinear transform function with small a is used, and for an error spectrum with a large standard deviation, a nonlinear transform function with large a is used. Since appropriate a depends on the property of first layer encoding, it is determined in advance by utilizing training data.

These nonlinear transform functions are provided as an example, and thus the present invention is not limited by which nonlinear transform function to use.

Next, the reason nonlinear transform is required when spectrum encoding is performed will be described. The dynamic range (the ratio of the maximum amplitude value to the minimum amplitude value) of a spectrum amplitude value is very large. Therefore, when, upon encoding an amplitude spectrum, linear quantization with a uniform quantization step size is applied, quite a large number of bits are required. If the number of coding bits is limited, when a small step size is set, a spectrum with a large amplitude value is clipped, and a quantization error in the clipped portion increases. On the other hand, when a large step size is set, a quantization error in spectrum with a small amplitude value increases. Therefore, when a signal with a large dynamic range such as an amplitude spectrum is encoded, a method is effective in which encoding is performed after nonlinear transform is performed using the nonlinear transform function. In this case, it becomes important to use an appropriate nonlinear transform function. When nonlinear transform is performed, a spectrum is separated into an amplitude value and positive and negative sign information, and nonlinear transform is performed on the amplitude value. Then, after the nonlinear transform, encoding is performed, and positive and negative sign information is added to the decoded value.

Although in the present embodiment, the description is made based on the configuration in which the entire band is processed at once, the present invention is not limited thereto. It is also possible to adopt a configuration where a spectrum is divided into a plurality of subbands, a standard deviation of an error spectrum is estimated for each subband from a standard deviation of the first layer decoded spectrum, and each subband spectrum is encoded using an optimal nonlinear transform function for the estimated standard deviation.

The degree of variation of the first layer decoded signal spectrum tends to be larger in lower band and tends to be smaller in higher band. By utilizing such a tendency, a plurality of nonlinear transform functions designed and prepared for each of a plurality of subbands may be used. In this case, a configuration is adopted in which a plurality of nonlinear transform function sections 410 are provided for each subband. That is, the nonlinear transform function sections corresponding to each subband have a set of nonlinear transform functions #1 to #N. Then, selecting section 409 selects, for each of the plurality of subbands, one of the plurality of nonlinear transform functions #1 to #N prepared for each of the plurality of subbands. By adopting such a configuration, it is possible to use an optimal nonlinear transform function for each subband, further improve the quantization performance, and improve sound quality.

Next, the configuration of a speech decoding apparatus according to Embodiment 1 of the present invention will be described using FIG. 8.

Figure 8:
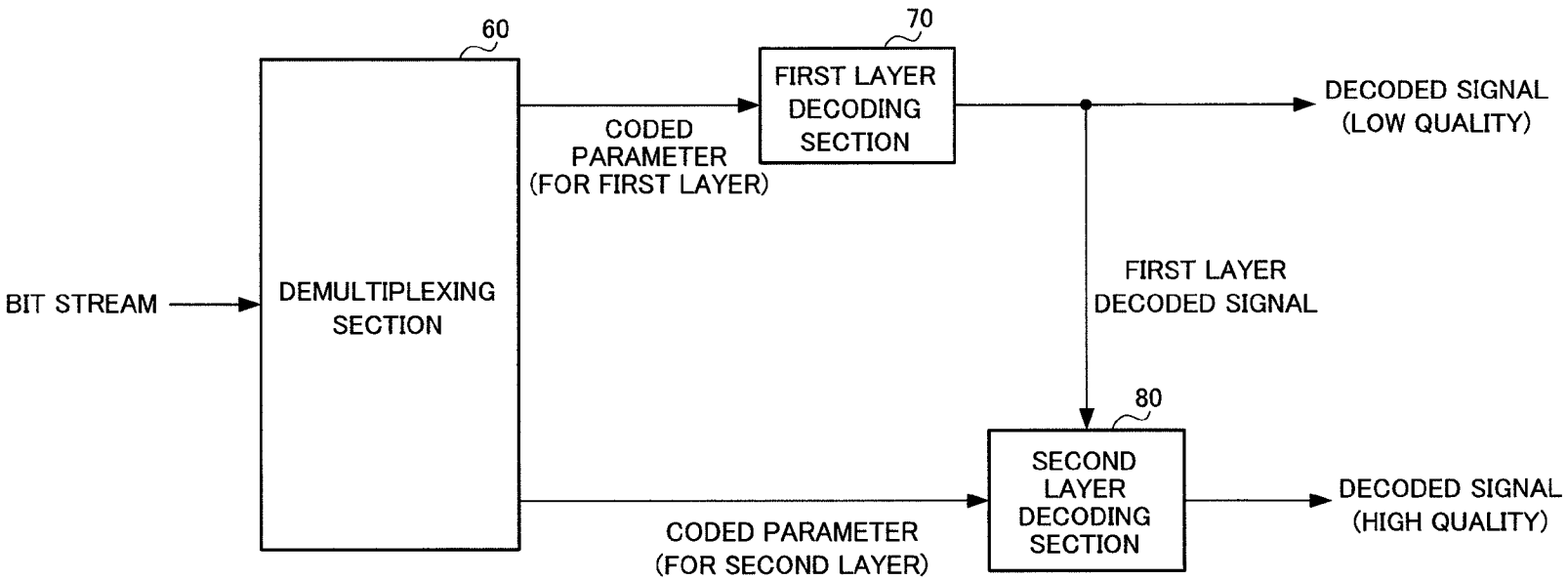
FIG. 8 is a block diagram showing the configuration of a speech decoding apparatus according to Embodiment 1 of the present invention.

In FIG. 8, demultiplexing section 60 separates a bit stream to be inputted into a coded parameter (for a first layer) and coded parameter (for a second layer) and outputs the coded parameters to first layer decoding section 70 and second layer decoding section 80, respectively. The coded parameter (for the first layer) is a coded parameter obtained by first layer coding section 10. For example, the coded parameter includes LPC coefficients, lag, excitation signal and gain information when CELP (Code Excited Linear Prediction) is used in first layer coding section 10. The coded parameter (for the second layer) is a coded parameter for a scale factor ratio and a coded parameter for a residual spectrum.

First layer decoding section 70 generates a first layer decoded signal from the first layer coded parameter and outputs the first layer decoded signal to second layer decoding section 80 and outputs as a low-quality decoded signal where necessary.

Second layer decoding section 80 generates a second layer decoded signal—a high-quality decoded signal—using the first layer decoded signal, the coded parameter for a scale factor ratio, and the coded parameter for a residual spectrum and outputs the decoded signal where necessary.

In this way, the minimum quality of reproduced speech can be guaranteed by a first layer decoded signal, and the quality of the reproduced speech can be improved by the second layer decoded signal. Whether the first layer decoded signal or the second layer decoded signal is outputted depends on whether the second layer coded parameter can be obtained due to network environment (such as occurrence of packet loss), or on an application or user settings.

Figure 9:
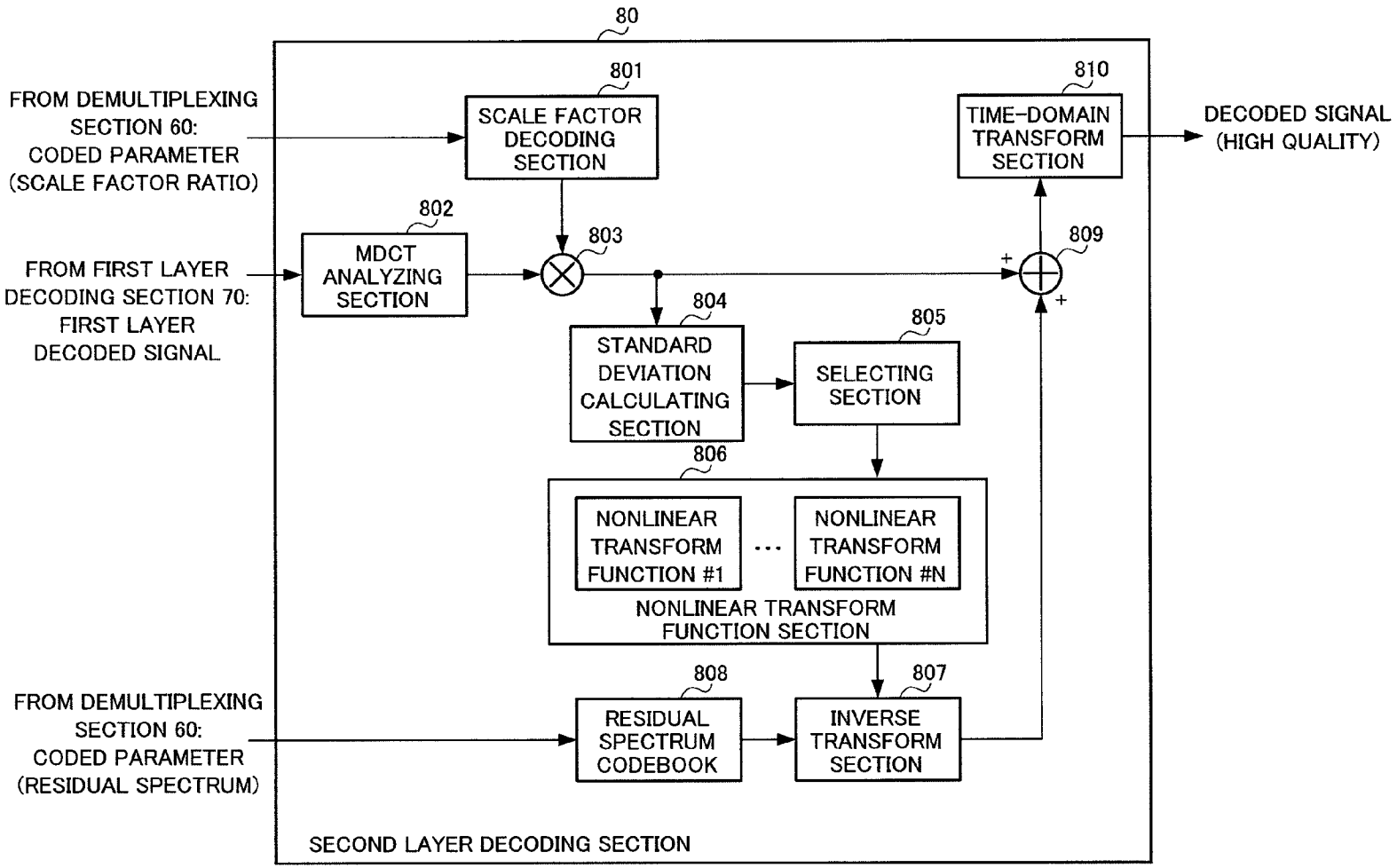
FIG. 9 is a block diagram showing the configuration of a second layer decoding section according to Embodiment 1 of the present invention.

Next, second layer decoding section 80 will be described in more detail. The configuration of second layer decoding section 80 is shown in FIG. 9. Scale factor decoding section 801, MDCT analyzing section 802, multiplier 803, standard deviation calculating section 804, selecting section 805, nonlinear transform function section 806, inverse transform section 807, residual spectrum codebook 808 and adder 809 which are shown in FIG. 9 correspond to scale factor decoding section 407, MDCT analyzing section 401, multiplier 405, standard deviation calculating section 408, selecting section 409, nonlinear transform function section 410, inverse transform section 411, residual spectrum codebook 412 and adder 413 which are included in second layer coding section 40 (FIG. 2) of the speech coding apparatus, respectively, and the corresponding components have the same functions.

In FIG. 9, scale factor decoding section 801 decodes a scale factor ratio based on the coded parameter for a scale factor ratio and outputs the decoded ratio (decoded scale factor ratio) to multiplier 803.

MDCT analyzing section 802 analyzes spectrum of the first layer decoded signal by MDCT transform and calculates MDCT coefficients (first layer decoded spectrum) and outputs the first layer decoded spectrum to multiplier 803.

Multiplier 803 multiplies the first layer decoded spectrum outputted from MDCT analyzing section 802 by the decoded scale factor ratio outputted from scale factor decoding section 801 for each corresponding subband, and outputs a multiplication result to standard deviation calculating section 804 and adder 809. As a result, the scale factor of the first layer decoded spectrum approximates the scale factor of the original spectrum.

Standard deviation calculating section 804 calculates standard deviation $\sigma c$ of the first layer decoded spectrum multiplied by the decoded scale factor ratio, and outputs standard deviation $\sigma c$ to selecting section 805. By the calculation of the standard deviation, the degree of variation of the first layer decoded spectrum is quantified.

Selecting section 805 selects which nonlinear transform function is used in inverse transform section 807 as a function for performing inverse nonlinear transform on the residual spectrum based on standard deviation $\sigma c$ outputted from standard deviation calculating section 804. Selecting section 805 then outputs information indicating a selection result to nonlinear transform function section 806.

Nonlinear transform function section 806 outputs one of a plurality of prepared nonlinear transform functions #1 to #N, to inverse transform section 807 based on the selection result obtained by selecting section 805.

Residual spectrum codebook 808 stores a plurality of residual spectrum candidates obtained by nonlinearly transforming and compressing the residual spectrum. The residual spectrum candidates stored in residual spectrum codebook 808 maybe scalars or vectors. Residual spectrum codebook 808 is designed in advance using training data.

Inverse transform section 807 performs inverse transform (expansion processing) on one of the residual spectrum candidates stored in residual spectrum codebook 808 using the nonlinear transform function outputted from nonlinear transform function section 806 and outputs the residual spectrum candidate to adder 809. A residual spectrum among the residual spectrum candidates which is subjected to inverse transform is selected according to the coded parameter for the residual spectrum inputted from demultiplexing section 60.

Adder 809 adds the inverse transformed (expanded) residual spectrum candidate to the first layer decoded spectrum multiplied by the decoded scale factor ratio, and outputs the result to time-domain transform section 810. The spectrum obtained as a result of the addition corresponds to a frequency-domain second layer decoded spectrum.

Time-domain transform section 810 transforms the second layer decoded spectrum into a time-domain signal and thereafter performs appropriate processing such as windowing and overlap-addition on the signal where necessary to avoid discontinuity occurring between frames and output a actual high-quality decoded signal.

In this way, according to the present embodiment, the degree of variation of the error spectrum is estimated from the degree of variation of the first layer decoded spectrum, and an optimal nonlinear transform function for the degree of variation is selected in the second layer. At this time, without transmitting selection information of the nonlinear transform function to the speech decoding apparatus from the speech coding apparatus, the speech decoding apparatus can select a nonlinear transform function, as with the speech coding apparatus. Therefore, in the present embodiment, it is not necessary to transmit selection information of the nonlinear transform function to the speech decoding apparatus from the speech coding apparatus. Accordingly, the quantization performance can be improved without increasing the bit rate.

Embodiment 2

Figure 10:
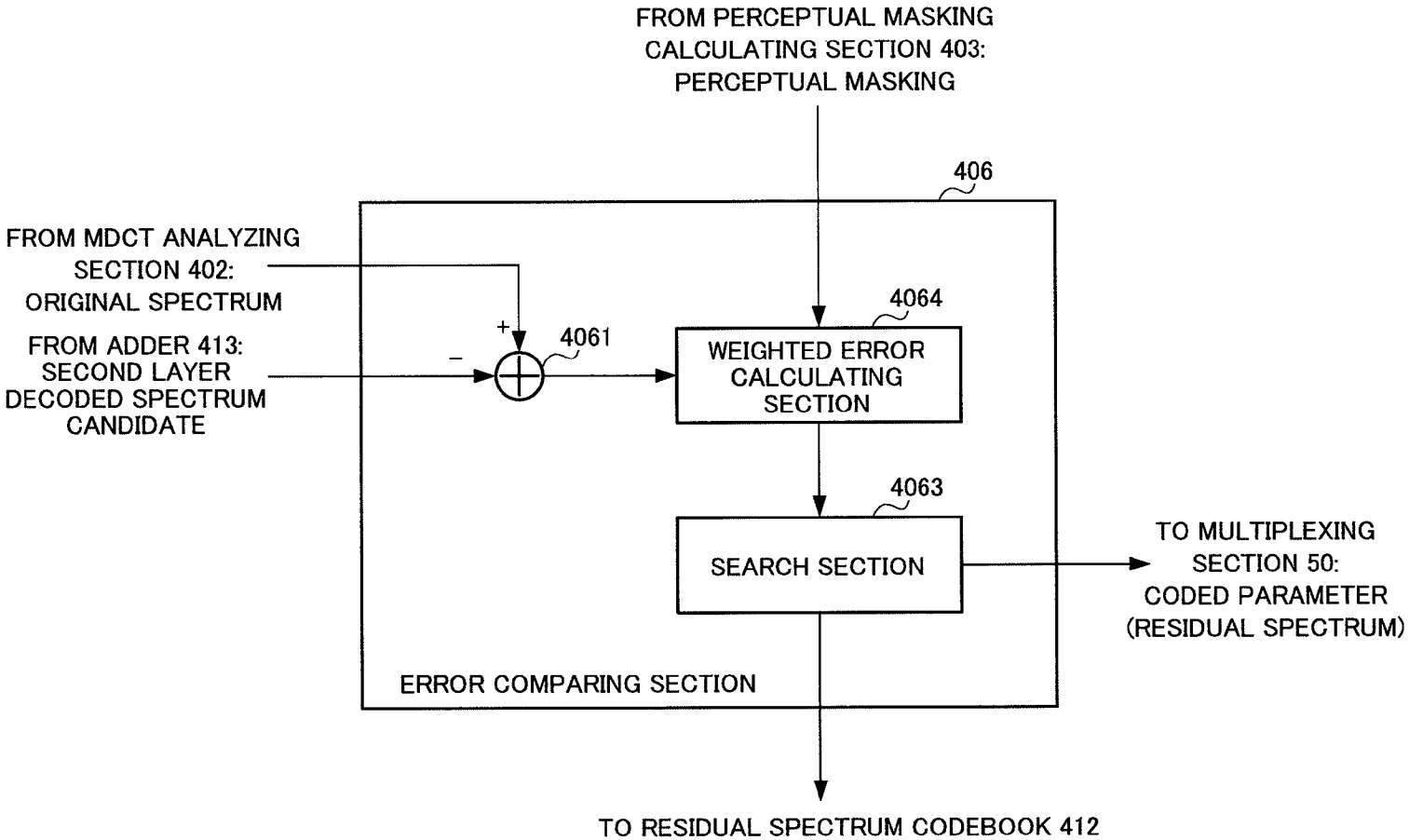
FIG. 10 is a block diagram showing the configuration of an error comparing section according to Embodiment 2 of the present invention.

The configuration of error comparing section 406 according to Embodiment 2 of the present invention is shown in FIG. 10. As shown in the drawing, error comparing section 406 according to the present embodiment includes weighted error calculating section 4064 instead of masking-to-error ratio calculating section 4062 included in the configuration (FIG. 3) according to Embodiment 1. In FIG. 10, components that are the same as those in FIG. 3 will be assigned the same reference numerals without further explanations.

Weighted error calculating section 4064 multiplies the error spectrum outputted from subtractor 4061 by a weighting function defined by perceptual masking and calculates its energy (weighted error energy). The weighting function is defined by the perceptual masking level. For a frequency with a high perceptual masking level, distortion at that frequency is difficult to be heard, and therefore the weight is set to a small value. In contrast, for a frequency with a low perceptual masking level, distortion at that frequency is easy to be heard, and therefore the weight is set to a large value. Weighted error calculating section 4064 thus assigns weights so that the influence of the error spectrum at a frequency with a high perceptual masking level is reduced and the influence of the error spectrum at a frequency with a low perceptual masking level is increased, and calculates energy. The calculated energy value is then outputted to search section 4063.

Search section 4063 searches for a residual spectrum candidate to be used to minimize the weighted error energy among part or all of the residual spectrum candidates in residual spectrum codebook 412, and outputs an coded parameter indicating the searched residual spectrum candidate to multiplexing section 50.

By performing such processing, a second layer coding section that reduces perceptual distortion can be realized.

Embodiment 3

Figure 11:
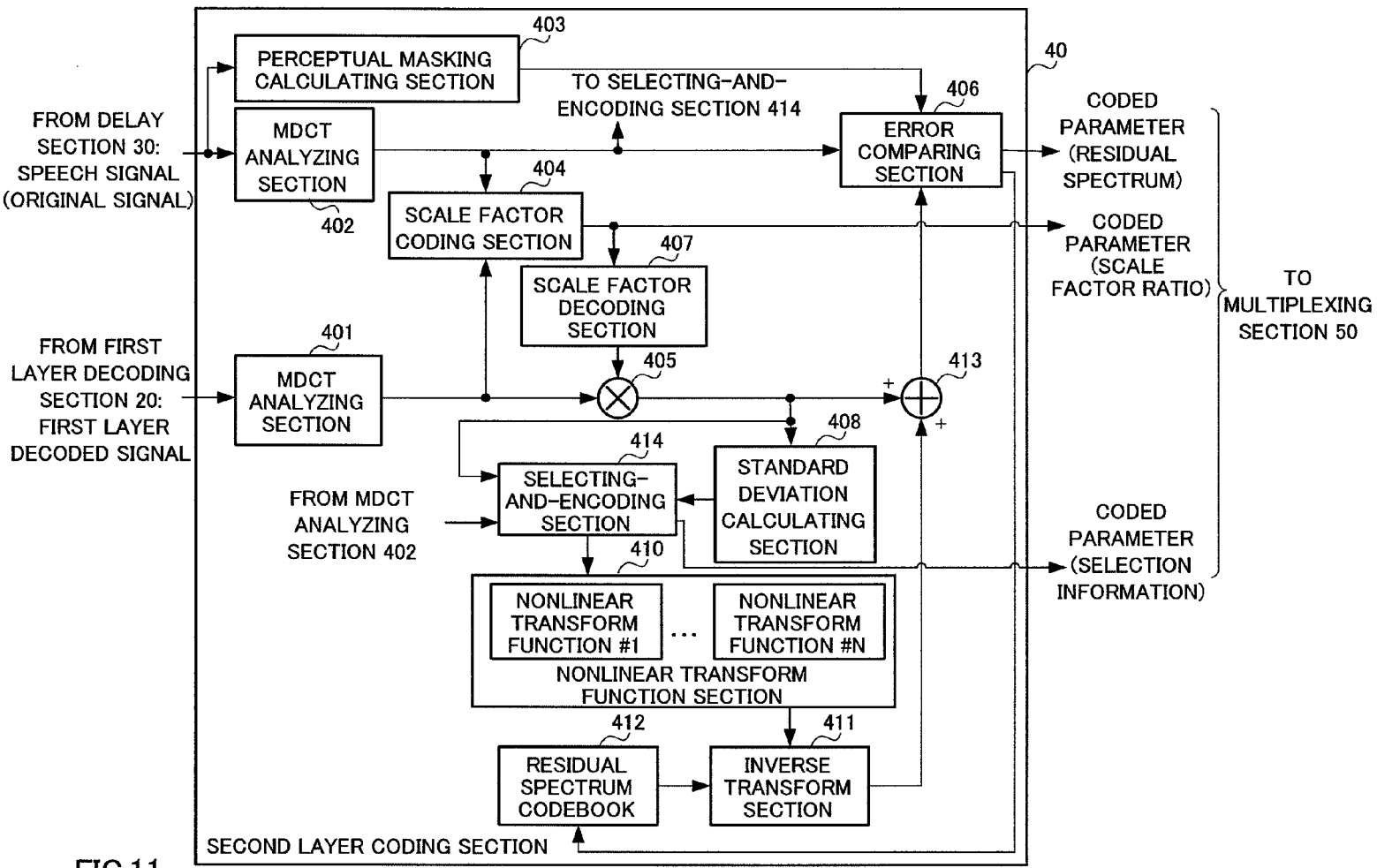
FIG. 11 is a block diagram showing the configuration of a second layer coding section according to Embodiment 3 of the present invention.

The configuration of second layer coding section 40 according to Embodiment 3 of the present invention is shown in FIG. 11. As shown in the drawing, second layer coding section 40 according to the present embodiment includes selecting-and-encoding section 414 instead of selecting section 409 included in the configuration (FIG. 2) according to Embodiment 1. In FIG. 11, components that are the same as those in FIG. 2 will be assigned the same reference numerals without further explanations.

To selecting-and-encoding section 414, the first layer decoded spectrum multiplied by a decoded scale factor ratio is inputted from multiplier 405 and standard deviation $\sigma c$ of the first layer decoded spectrum is inputted from standard deviation calculating section 408. In addition, the original spectrum is inputted to selecting-and-encoding section 414 from MDCT analyzing section 402.

Selecting-and-encoding section 414 first limits values that the estimated standard deviation of the error spectrum can take, based on standard deviation $\sigma c$. Then, selecting-and-encoding section 414 obtains the error spectrum from the original spectrum and the first layer decoded spectrum multiplied by the decoded scale factor ratio, calculates a standard deviation of the error spectrum, and selects an estimated standard deviation closest to the standard deviation from the estimated standard deviations limited in the above-described manner. Selecting-and-encoding section 414 then selects a nonlinear transform function according to the selected estimated standard deviation (the degree of variation of the error spectrum) as in Embodiment 1, and outputs the coded parameter in which selection information indicating the selected estimated standard deviation is encoded, to multiplexing section 50.

Multiplexing section 50 multiplexes the coded parameter outputted from first layer coding section 10, the coded parameter outputted from second layer coding section 40, and the coded parameter outputted from selecting-and-encoding section 414, and outputs the multiplexed parameter as a bit stream.

Figure 12:
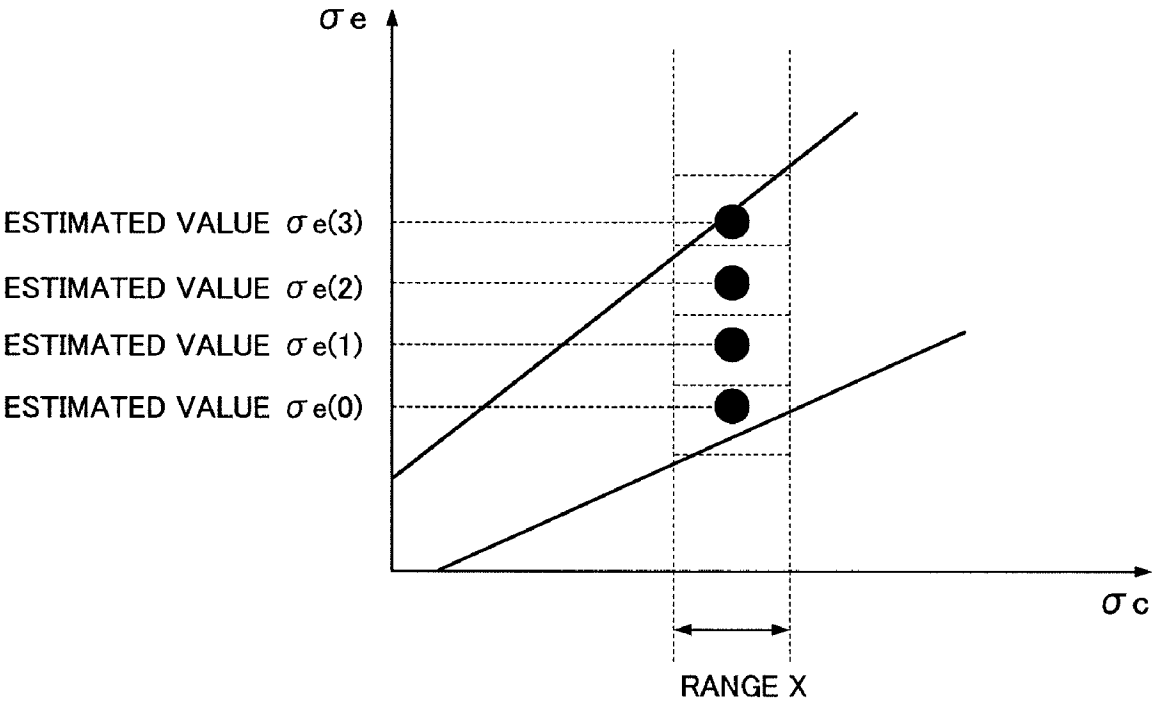
FIG. 12 shows a method of estimating a standard deviation of an error spectrum according to Embodiment 3 of the present invention.

A method of selecting an estimated value of the standard deviation of the error spectrum in selecting-and-encoding section 414 will be described in more detail using FIG. 12. In FIG. 12, the horizontal axis represents standard deviation $\sigma c$ of the first layer decoded spectrum, and the vertical axis represents standard deviation $\sigma e$ of the error spectrum. When standard deviation $\sigma c$ of the first layer decoded spectrum belongs to range X, the estimated value of the standard deviation of the error spectrum is limited to any one of estimated value $\sigma e(0)$, estimated value $\sigma e(1)$, estimated value $\sigma e(2)$ and estimated value $\sigma e(3)$. From these four estimated values, an estimated value is selected that is closest to the standard deviation of the error spectrum obtained from the original spectrum and the first layer decoded spectrum multiplied by the decoded scale factor ratio.

In this way, a plurality of estimated values that the estimated standard deviation of the error spectrum can take are limited based on the standard deviation of the first layer decoded spectrum, and the estimated value that is closest to the standard deviation of the error spectrum obtained from the original spectrum and the first layer decoded spectrum multiplied by the decoded scale factor ratio is selected from the limited estimated values, so that, by encoding fluctuations in the estimated value due to the standard deviation of the first layer decoded spectrum, it is possible to obtain a more accurate standard deviation, further improve quantization performance, and improve sound quality.

Figure 13:
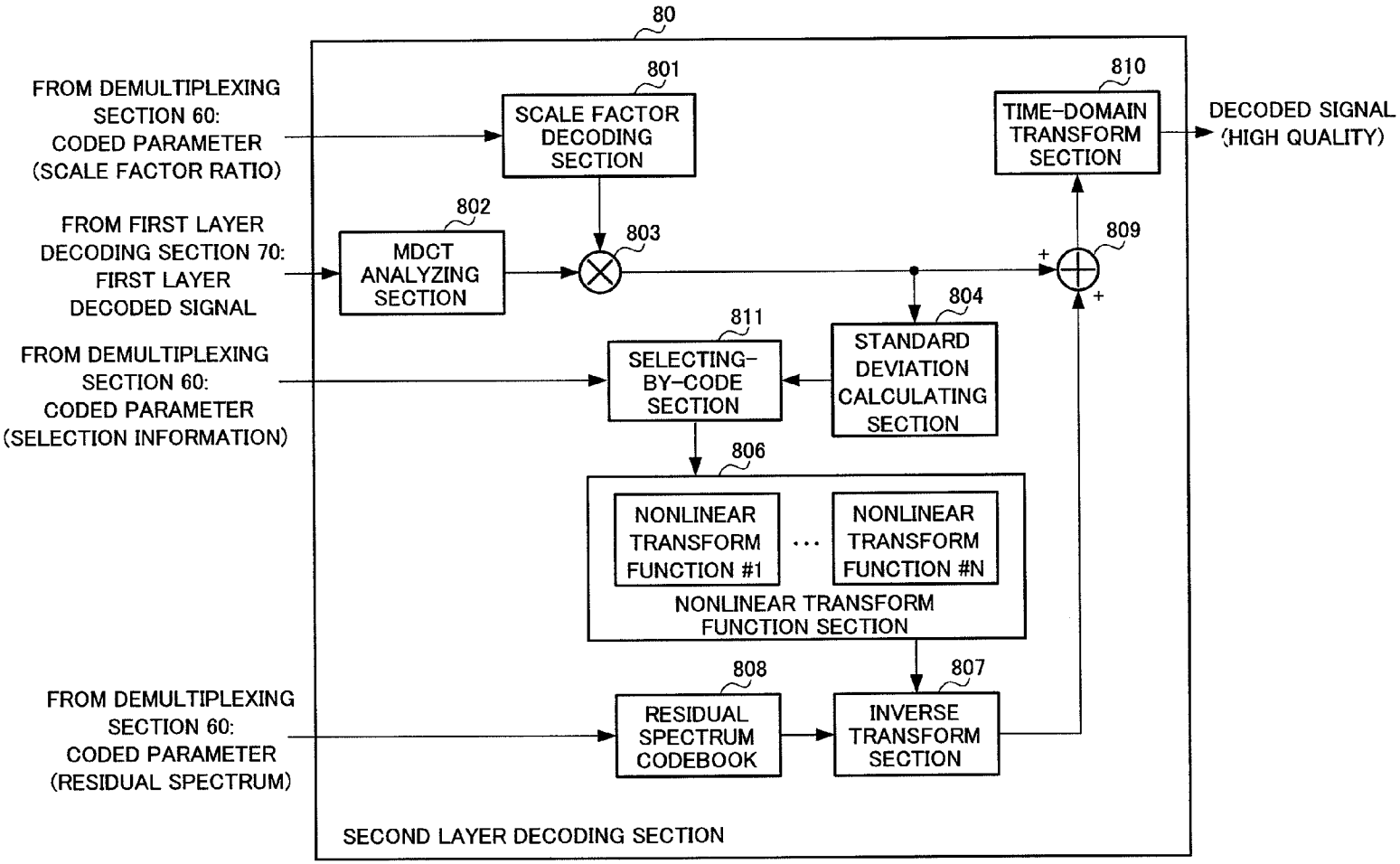
FIG. 13 is a block diagram showing the configuration of a second layer decoding section according to Embodiment 3 of the present invention.

Next, the configuration of second layer decoding section 80 according to Embodiment 3 of the present invention will be described using FIG. 13. As shown in the drawing, second layer decoding section 80 according to the present embodiment includes selecting-by-code section 811 instead of selecting section 805 included in the configuration (FIG. 9) according to Embodiment 1. In FIG. 13, components that are the same as those in FIG. 9 will be assigned the same reference numerals without further explanations.

To selecting-by-code section 811, a coded parameter for selection information separated by demultiplexing section 60 is inputted. Selecting-by-code section 811 selects which nonlinear transform function to use as a function used to perform nonlinear transform on the residual spectrum based on the estimated standard deviation indicated by the selection information. Selecting-by-code section 811 then outputs information indicating the selection result to nonlinear transform function section 806.

The embodiments of the present invention have been described above.

In the above-described embodiments, without using the standard deviation of the first layer decoded spectrum, the standard deviation of the error spectrum may be directly encoded. In such a case, although the amount of codes for representing the standard deviation of the error spectrum increases, the quantization performance of a frame having small correlation between the standard deviation of the first layer decoded spectrum and the standard deviation of the error spectrum can also be improved.

It is also possible to switch, for each frame, between processing (i) of limiting estimated values that the standard deviation of the error spectrum can take based on the standard deviation of the first layer decoded spectrum and processing (ii) of directly encoding the standard deviation of the error spectrum without using the standard deviation of the first layer decoded spectrum. In this case, for a frame in which the correlation between the standard deviation of the first layer decoded spectrum and the standard deviation of the error spectrum is equal to or greater than a predetermined value, the processing (i) is performed, and for a frame in which such correlation is less than the predetermined value, the processing (ii) is performed. By thus adaptively switching between the processing (i) and the processing (ii) according to a correlation value between the standard deviation of the first layer decoded spectrum and the standard deviation of the error spectrum, the quantization performance can be further improved.

In the above-described embodiments, the standard deviation is used as an index indicating the degree of variation of the spectrum, but distribution, the difference or ratio between a maximum amplitude spectrum and a minimum amplitude spectrum may also be used.

Although, in the above-described embodiments, the case of using MDCT as a transform method has been described, the present invention is not limited thereto, and the present invention can also be similarly applied when other transform methods, for example, DFT, cosine transform and Wavelet transform, are used.

Although, in the above-described embodiments, the layered structure of scalable coding is described as having two layers including a first layer (lower layer) and a second layer (upper layer), the present invention is not limited thereto, and the present invention can also be similarly applied to scalable coding having three or more layers. In this case, the present invention can be similarly applied by regarding one of a plurality of layers as the first layer in the above-described embodiments and a layer which is at a higher rank than that layer as the second layer.

In addition, even when the sampling rates of signals used in layers are different from each other, the present invention can be applied. When the sampling rate of a signal used in an n-th layer is represented as Fs (n), the relationship $Fs(n) \leqq Fs(n+1)$ is satisfied.

The speech coding apparatus and the speech decoding apparatus according to the above-described embodiments can also be provided to a radio communication apparatus such as a radio communication mobile station apparatus and a radio communication base station apparatus used in a mobile communication system.

In the above embodiments, the case has been described as an example where the present invention is implemented with hardware, the present invention can be implemented with software.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-312262, filed on Oct. 27, 2004, the entire content of which is expressly incorporated by reference herein.

INDUSTRIAL APPLICABILITY

The present invention can be applied to a communication apparatus such as in a mobile communication system and a packet communication system using the Internet Protocol.

The invention claimed is:

1. A speech coding apparatus that performs coding having a layered structure composed of a plurality of layers, the speech coding apparatus comprising:

an analyzer, including a first circuit, that analyzes a spectrum of a decoded signal of a lower layer to calculate a decoded spectrum of the lower layer;

a selector, including a second circuit, that selects one nonlinear transform function from among a plurality of nonlinear transform functions based on a degree of variation of the decoded spectrum of the lower layer, the degree of variation being a standard deviation of the decoded spectrum of the lower layer;

an inverse transformer, including a third circuit, that inverse transforms a nonlinear transformed residual spectrum using the one nonlinear transform function selected by the selector to obtain an inverse transformed residual spectrum; and an adder, including a fourth circuit, that adds the inverse transformed residual spectrum to the decoded spectrum of the lower layer to obtain a decoded spectrum of an upper layer.

2. The speech coding apparatus according to claim 1, further comprising a plurality of residual spectrum codebooks that correspond to the plurality of nonlinear transform functions.

3. The speech coding apparatus according to claim 2, further comprising:

an error comparer, including a fifth circuit, that selects one residual spectrum codebook that corresponds to the one nonlinear transform function from among the plurality of residual spectrum codebooks, and selects one residual spectrum candidate from among a plurality of residual spectrum candidates included in the one residual spectrum codebook, wherein the inverse transformer inverse transforms the one residual spectrum candidate selected by the error comparer using the one nonlinear transform function selected by the selector to obtain the inverse transformed residual spectrum.

4. The speech coding apparatus according to claim 3, wherein the error comparer selects the one residual spectrum candidate including a highest masking-to-error ratio from among the plurality of residual spectrum candidates.

5. The speech coding apparatus according to claim 3, wherein the error comparer selects the one residual spectrum candidate including a lowest weighted error energy from among the plurality of residual spectrum candidates.

6. The speech coding apparatus according to claim 1, wherein the selector selects, for each of a plurality of subbands, one nonlinear transform function from among the plurality of nonlinear transform functions.

7. The speech coding apparatus according to claim 6, wherein the plurality of nonlinear transform functions are included in a plurality of sets of nonlinear transform functions, and the selector selects, for each of the plurality of subbands, the one nonlinear transform function from a corresponding one of the plurality of sets of nonlinear transform functions.

8. The speech coding apparatus according to claim 1, wherein the selector selects the one nonlinear transform function from among the plurality of nonlinear transform functions according to a degree of variation of an error spectrum estimated from the degree of variation of the decoded spectrum of the lower layer.

9. The speech coding apparatus according to claim 8, wherein the degree of variation of the error spectrum is an estimated standard deviation of the error spectrum.

10. The speech coding apparatus according to claim 8, wherein the selector further encodes information indicating the degree of variation of the error spectrum.

11. The speech coding apparatus according to claim 1, wherein the selector selects the one nonlinear transform function based on the degree of variation of the decoded spectrum of the lower layer without receiving selection information of the one nonlinear transform function.

12. A radio communication mobile station apparatus comprising the speech coding apparatus according to claim 1.

13. A radio communication base station apparatus comprising the speech coding apparatus according to claim 1.

14. A speech coding method implemented in at least one of at least one circuit and at least one processor for performing coding having a layered structure composed of a plurality of layers, the speech coding method comprising:

analyzing, with the at least one of the at least one circuit and the at least one processor, a spectrum of a decoded signal of a lower layer to calculate a decoded spectrum of the lower layer;

selecting, with the at least one of the at least one circuit and the at least one processor, one nonlinear transform function from among a plurality of nonlinear transform functions based on a degree of variation of the decoded spectrum of the lower layer, the degree of variation being a standard deviation of the decoded spectrum of the lower layer;

inverse transforming, with the at least one of the at least one circuit and the at least one processor, a nonlinearly transformed residual spectrum using the one nonlinear transform function to obtain an inverse transformed residual spectrum; and adding, with the at least one of the at least one circuit and the at least one processor, the inverse transformed residual spectrum to the decoded spectrum of the lower layer to obtain a decoded spectrum of an upper layer.

15. The speech coding method according to claim 14, wherein the one nonlinear transform function is selected based on the degree of variation of the decoded spectrum of the lower layer without receiving selection information of the one nonlinear transform function.

16. The speech coding method according to claim 14, further comprising:

selecting, with the at least one of the at least one circuit and the at least one processor, one residual spectrum codebook that corresponds to the one nonlinear transform function from among a plurality of residual spectrum codebooks; and selecting, with the at least one of the at least one circuit and the at least one processor, one residual spectrum candidate from among a plurality of residual spectrum candidates included in the one residual spectrum codebook, wherein the one residual spectrum candidate is inverse transformed using the one nonlinear transform function to obtain the inverse transformed residual spectrum.

17. The speech coding method according to claim 16, wherein the one residual spectrum candidate includes a highest masking-to-error ratio from among the plurality of residual spectrum candidates.

18. The speech coding method according to claim 16, wherein the one residual spectrum candidate includes a lowest weighted error energy from among the plurality of residual spectrum candidates.

19. The speech coding method according to claim 14, further comprising:

dividing, with the at least one of the at least one circuit and the at least one processor, the spectrum of the decoded signal into a plurality of subbands; and selecting, with the at least one of the at least one circuit and the at least one processor for each of the plurality of subbands, one set of nonlinear transform functions from among a plurality of sets of nonlinear transform functions, and one nonlinear transform function from the one set of nonlinear transform functions.

20. The speech coding method according to claim 14, wherein the one nonlinear transform function is selected from among the plurality of nonlinear transform functions according to a degree of variation of an error spectrum estimated from the degree of variation of the decoded spectrum of the lower layer, the degree of variation of the error spectrum being an estimated standard deviation of the error spectrum.

* * * * *